US007441715B2

(12) United States Patent
Carta

(10) Patent No.: US 7,441,715 B2
(45) Date of Patent: Oct. 28, 2008

(54) ADJUSTABLE AND SEALABLE JET NEBULISER FOR BOTTLES ABLE TO BE ELASTICALLY DEFORMED BY SQUEEZING

(75) Inventor: Lamberto Carta, Pescara (IT)

(73) Assignee: EMSAR S.p.A., San Giovanni Teatino (CH) (IT)

( * ) Notice: Subject to any disclaimer, the term of this patent is extended or adjusted under 35 U.S.C. 154(b) by 0 days.

(21) Appl. No.: 10/592,940

(22) PCT Filed: Feb. 24, 2005

(86) PCT No.: PCT/IT2005/000102

§ 371 (c)(1),
(2), (4) Date: Sep. 15, 2006

(87) PCT Pub. No.: WO2005/089953

PCT Pub. Date: Sep. 29, 2005

(65) Prior Publication Data

US 2007/0176021 A1 Aug. 2, 2007

(30) Foreign Application Priority Data

Mar. 19, 2004 (IT) ..... RM 2004 A 000142

(51) Int. Cl.
*B65D 1/32* (2006.01)

(52) U.S. Cl. ..... 239/327; 239/539; 239/424; 222/189; 222/190; 222/212; 222/524

(58) Field of Classification Search ..... 239/424, 239/327, 314, 418, 533.1, 570, 539; 222/321.3, 222/321, 496, 330, 380, 402.1, 145.5, 212, 222/189

See application file for complete search history.

(56) References Cited

U.S. PATENT DOCUMENTS 3,221,952 A * 12/1965 De See ..... 222/525
4,432,496 A 2/1984 Ito et al.
4,615,467 A 10/1986 Grogan et al.

(Continued)

FOREIGN PATENT DOCUMENTS

EP 0 439 109 7/1991

OTHER PUBLICATIONS

Patent Abstracts of Japan vol. 1999, No. 9, Jul. 30, 1999 - & JP 11 105907 A (Kao Corp), Apr. 20, 1999 abstract.

*Primary Examiner*—Dinh Q Nguyen
(74) *Attorney, Agent, or Firm*—Young & Thompson

(57) ABSTRACT

An adjustable and sealable jet nebulizer for bottles able to be elastically deformed by squeezing is mounted on the mouth of the neck (2) of a bottle (3). A conduit for air (16) and a conduit for liquid (17) are obtained coaxially in a cylindrical body (4) of the nebulizer, which is engaged with a screw-on cap (28), provided with a central exhaust orifice (29). The screw-on cap (28) has a cylindrical wall (30), to be inserted between the conduit for air (16) and the conduit for liquid (17), to create a mixing chamber (33) with variable geometry. The conduit for liquid (17) has on its upper end an arm (26) oriented upwards, bearing, at its free end, a tip cap (27), able to be inserted into the central exhaust orifice (29) whilst the screw-on cap (28) is screwed onto the cylindrical body (9), until sealing the nebulizer.

11 Claims, 5 Drawing Sheets

U.S. PATENT DOCUMENTS 4,830,284 A * 5/1989 Maerte ..... 239/333
5,310,097 A * 5/1994 Leuenberger ..... 222/521
6,513,681 B2 * 2/2003 Gross et al. ..... 222/211
7,159,798 B2 * 1/2007 Carta ..... 239/424

* cited by examiner

ADJUSTABLE AND SEALABLE JET NEBULISER FOR BOTTLES ABLE TO BE ELASTICALLY DEFORMED BY SQUEEZING

TECHNICAL FIELD

The present invention relates to an adjustable and sealable jet nebuliser for bottles able to be elastically deformed by squeezing, operating thanks to the dynamic action of an air flow on a liquid, when both these fluids, contained inside the bottle, are ejected therefrom by its manual squeezing.

BACKGROUND ART

U.S. Pat. No. 4,186,882 granted on 5 Feb. 1980, discloses a nebuliser of liquid which comprises a manually deformable container having a neck and an opening. On the opening is provided an elastic baffle provided with holes, supporting at its centre a liquid distribution nozzle connected to a suction tube. On the opening is also applied a covering element provided with a central exhaust orifice. Between the covering element and the elastic baffle is created a mixing chamber in which the liquid coming from the interior of the container through the suction tube is mixed with the air escaping due to the internal overpressure of the container through the holes of the elastic diaphragm.

The flow rate and density of the jet is regulated by varying the distance between the covering element and the liquid distribution nozzle thanks to a screw-on coupling between the covering element and the neck of the bottle.

Lastly, on the covering element is applied a screw-on cap which closes the mixing chamber, preventing liquid from escaping outwards.

While nebulisers of this kind are widely used on bottles for mass-distributed products, they are nonetheless not very practical because they have an additional element to be handled during use. After unscrewing the cap, the user has to stow it temporarily, if (s)he is unable to hold it in his/her hands, then retrieve it after use and close the bottle therewith. A series of drawbacks can be encountered, e.g. the annoying search for the cap, the possibility that it may be lost or that someone, such as a small child, may use it improperly. Moreover, in this kind of nebuliser, as mentioned above, the jet is regulated with the covering element, whilst the closure has to be performed by screwing the cap on. This entails a waste of time for the user.

There is also an Italian patent by the same Applicant, pertaining to a nebulisation dispenser head for bottles which can be elastically deformed by squeezing, wherein the jet is orthogonal to the axis of the bottle. In this dispenser head, a veritable closing door is applied, which may be completed by a tip cap which, entering the outlet hole of the product, allows to seal the system. The door can also be hinged in fixed fashion to the nebuliser device for more a practical operation. This system, which is nonetheless highly limiting with respect to practicable aesthetic solutions, acts exclusively as an on-off device, whereas it is generally important to allow a certain modulation of the spray.

DISCLOSURE OF INVENTION

Therefore, one object of the present invention is to provide a nebuliser to be applied to elastically deformable bottles, which can be closed and sealed in an easy and intuitive manner operating as a common screw-on cap, but which at the same time is practical and safe, in particular avoiding the presence of removable parts.

Another object of the invention is to provide a nebuliser whose general appearance is similar to that of the closure stopper or the covering cap on normal bottles.

An additional object of the invention is to provide a nebuliser to be applied on elastically deformable bottles in such a way that the jet, oriented according to the axis of the bottle, can be regulated by the user with the same operation that leads to the sealing of the nebuliser.

The aforementioned objects are achieved by an adjustable and sealable nebuliser for bottles able to be elastically deformed by squeezing, which can be mounted on the mouth of the neck of a bottle and comprising a conduit for the liquid, connected, through a non return valve, to a suction tube which draws a liquid contained within the bottle under a volume of air, and a conduit for the air communicating with the volume of air of the bottle, surrounding the conduit for the liquid and ending, together with the conduit for the liquid in a mixing chamber communicating with the exterior through a central exhaust orifice, which, from a general viewpoint, is characterised in that the conduit for the air and the conduit for the liquid are constructed coaxially in a cylindrical body, having, in its portion projecting from the mouth of the bottle neck, an external thread to be engaged with an internal counter-thread obtained in a screw-on cap, provided with the central exhaust orifice, the screw-on cap having a cylindrical wall, which is inserted between the conduit for the air and the conduit for the liquid, to create a mixing chamber with variable geometry; and the conduit for the liquid having on its upper end an arm oriented upwards, bearing, at its free end, a tip cap, able to be inserted into the central exhaust orifice whilst the screw-on cap is screwed onto the cylindrical body, until achieving the sealing of the nebuliser.

Advantageously, the nebuliser according to the invention has within it closure means which operatively and aesthetically resemble a common cap, but such means are assembled in such a way as not to be removable by the user.

Moreover, both the operations of adjusting the flow rate of the liquid and the size of the particles of the nebulised jet and of sealing the nebuliser are performed with the same closure means.

The nebulised jet is adjusted in simple but, at the same time, precise fashion. Moreover, it is advantageous, because it makes even more intuitive the operating procedures, that this adjustment is performed in the passage from a closed position to an ever more open position by a rotation of screw-on closure means.

The invention shall be more readily apparent from the detailed description that follows of an embodiment thereof, considered together with the accompanying drawing, in which.

DESCRIPTION OF THE ILLUSTRATIVE EMBODIMENTS

Figure 1:
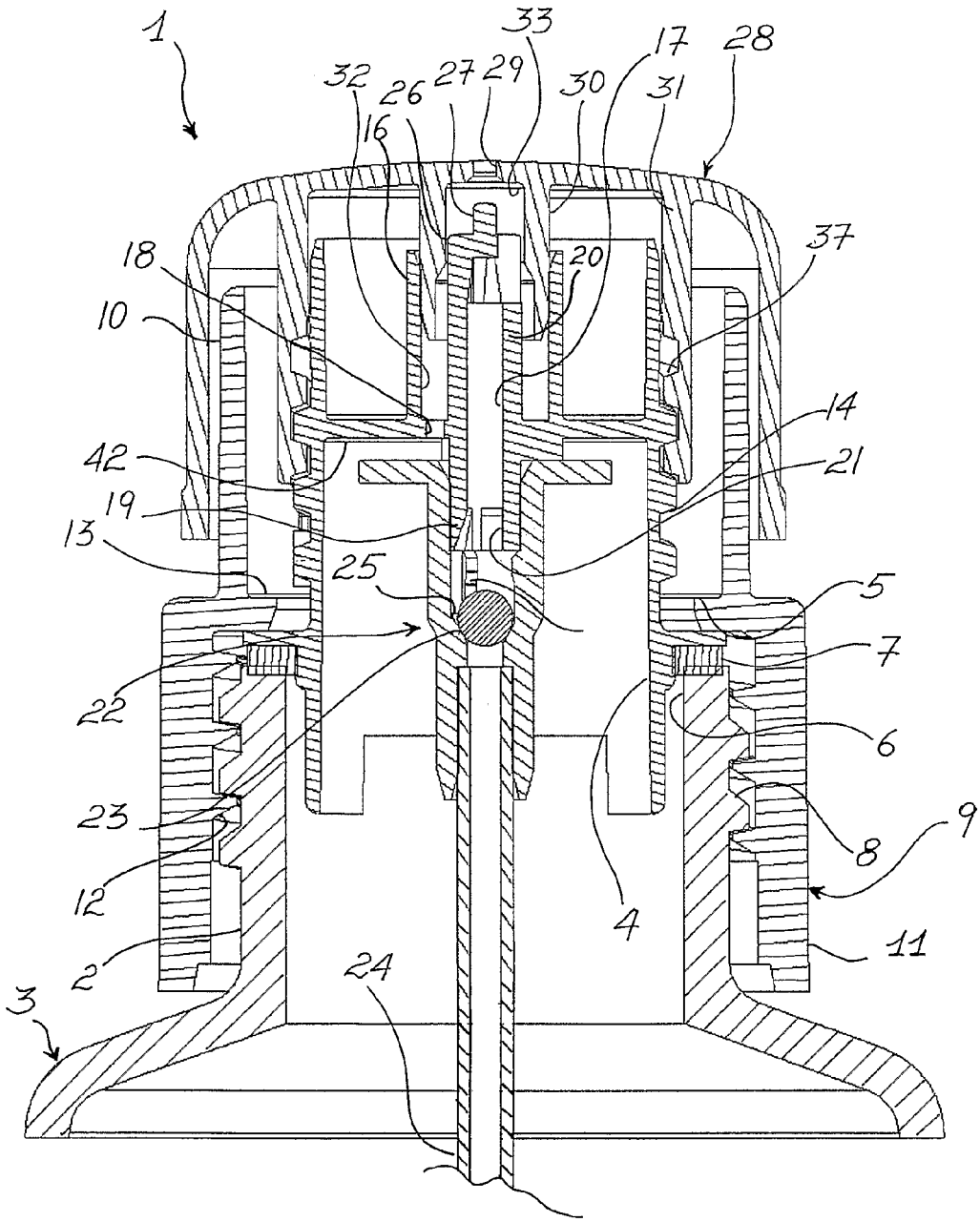
FIG. 1 is a longitudinal axial section of a nebuliser according to the invention in open position.
Figure 2:
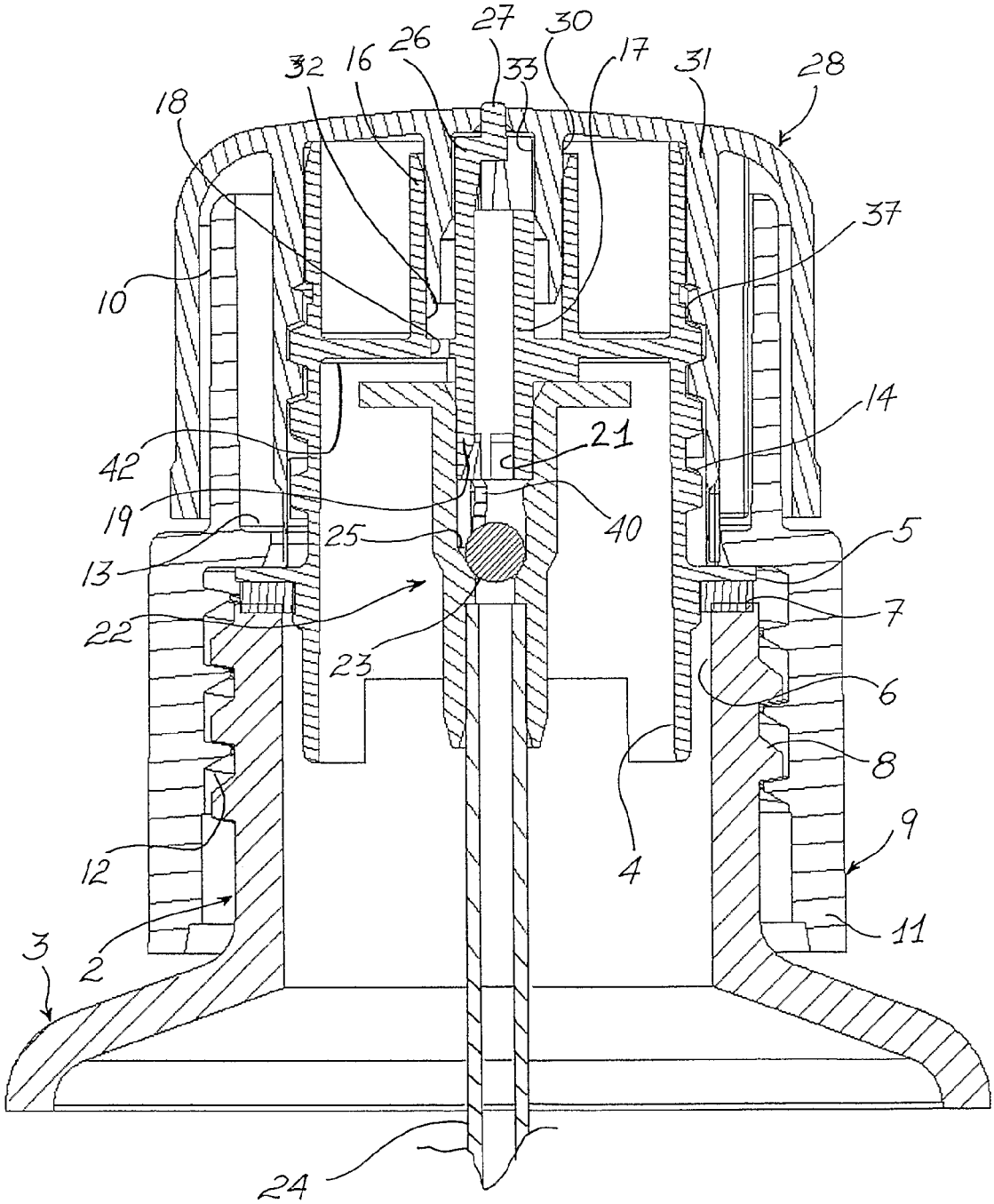
FIG. 2 is a longitudinal axial section of the nebuliser of FIG. 1 in closed position.

With reference initially to the accompanying figures, FIGS. 1 and 2, which are longitudinal axial sections of the nebuliser according to the present invention, the number 1 globally designates the nebuliser applied on the neck 2 of a bottle 3, which contains the liquid to be nebulised. The bottle 3, shown only partially, is of the type that can be deformed elastically by squeezing. As shall be explained below, the nebuliser 1 according to the illustrated embodiment is connected to the bottle 3 by threaded coupling, but it is evident that the connection could also have been of a different type.

The nebuliser 1 comprises a substantially cylindrical body 4, provided on its external periphery, of a flange 5 which allows it to bear on the mouth 6 of the neck 2 of the bottle 3. Between the flange 5 of the body 4 and the mouth 6 of the neck 2 is interposed a sealing gasket 7. The neck 2 is externally provided with a thread 8. The flange 5 of the body 4 is secured to the neck 2 of the bottle 3 by means of a threaded ring nut 9. The threaded ring nut 9, preferably in the form of a sleeve, has an upper portion 10 with a smaller diameter than that of its lower portion 11, which is internally provided with a thread 12. Naturally, the terms "upper" and "lower" refer to the position of the ring nut or of other parts of the nebuliser in the working condition. Between the upper portion 10 and the lower portion 11 of the ring nut is an annulus shaped inner projection 13.

Figure 3:
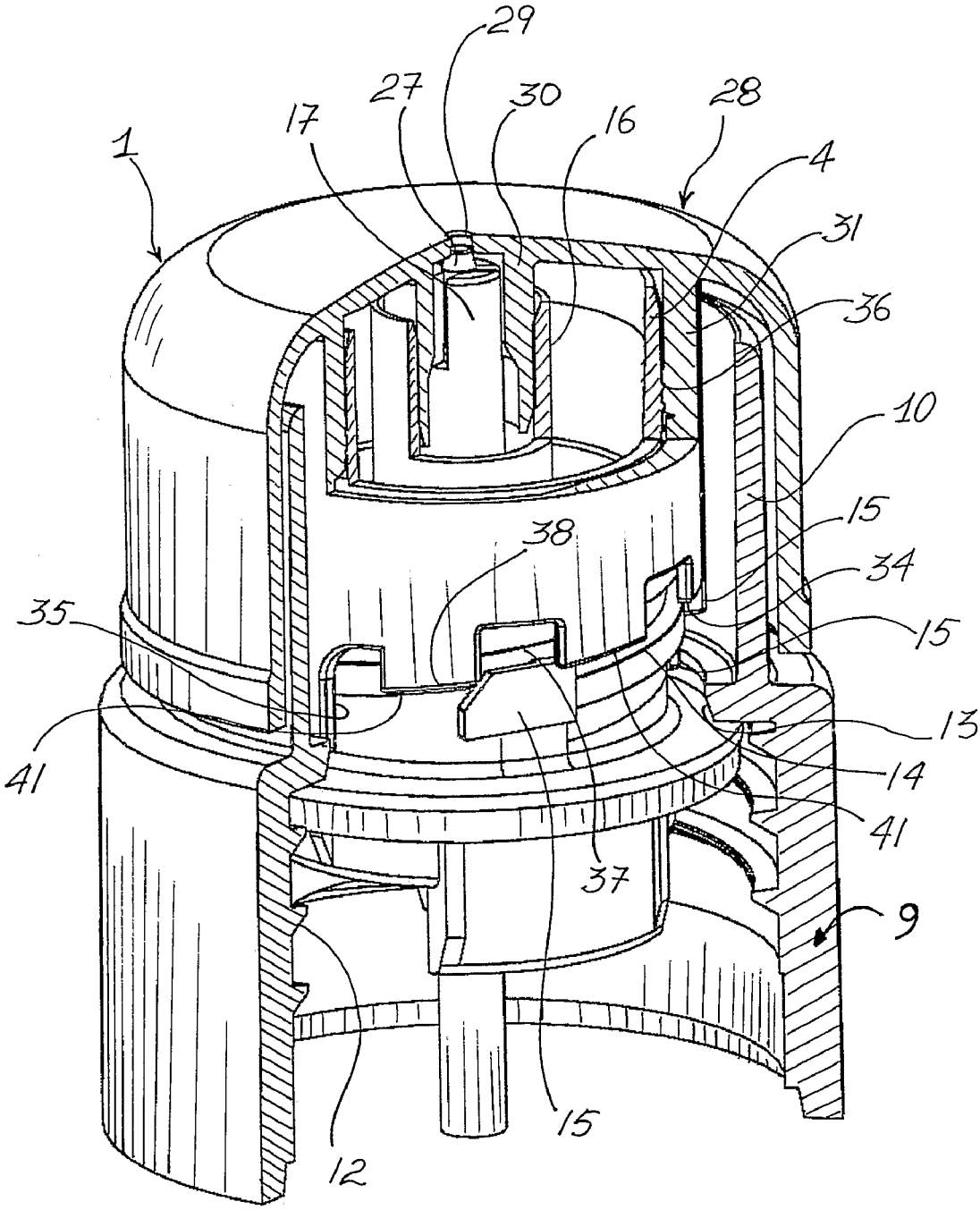
FIG. 3 is a schematic axonometric, partially cut off view of the nebuliser of FIG. 1, in partially closed position.

In its upper part, the body 4 externally has a thread 14. As shown in FIG. 3, which is an axonometric view of the nebuliser cut according to vertical and horizontal planes, in proximity to the lower end of the thread 14 are provided anti-unscrewing tabs 15, as contrast means present on the body 4. Every anti-unscrewing tab 15 is fastened tangentially to the body 4.

The thread 12 of the lower portion 11 of the ring nut 9 engages the thread 8 of the body 2, and by tightening thereon it blocks the flange 5. To avoid disassembling the semi-finished product constituted by the ring nut 9 and by the body 4, during the productive mounting phases, the projection 13 of the ring nut 9 is fixed below the aforesaid anti-unscrewing tabs 15 present on the body 4. Every anti-unscrewing tab 15 has a chamfer 38 in order to bend inwards under the action of the ring nut 9 during the fitting thereof, which otherwise would be impossible. This connection also assures the free rotation of the ring nut 9 to allow the orientation of the nebuliser when screwing on the bottle 3.

Inside the cylindrical body 4, a transverse, i.e. horizontal wall 42, is provided with two coaxial conduits, i.e. an outer conduit 16 for the passage of air and an inner conduit 17 for the passage of the liquid. Both passages 16 and 17 are in communication with the interior of the bottle 3. The outer conduit 16 for the passage of air is in communication with the interior of the bottle 3 thanks to at least one through hole 18 obtained in the lower part of the outer conduit 16.

The inner conduit 17 for the passage of the liquid projects both downwards and upwards with respect to the transverse wall 42, in respective sections 19 and 20. The lower section 19, tapered upwards, in spokes, in its inner segment 21, is connected externally with a cup fitting 22. In the cup fitting 22 is obtained a conical seat 25 for a ball 23, thereby obtaining a check valve. In the cup fitting 22 is inserted from the bottom a suction tube 24, destined to draw in the low part (not shown) of the bottle 3.

The check valve uses the ball 23, which is placed inside the conical seat 25 and it is secured by the spokes 40 present inside the cup 22. The valve thereby lets the liquid drawn from bottle flow upwards through the suction tube 24, but does not let it flow back.

The upper section 20 of the inner conduit 17 for the liquid is superiorly provided with an arm 26 oriented upwards, bearing at its free end a tip cap 27, whose function shall be explained below. The tip cap is preferably cone frustum shaped.

The nebuliser 1 is completed by a screw-on cap 28. The screw-on cap 28, which has a cupola, able to cover with its peripheral walls the upper part 10 of the ring nut 9 and provided with a through hole serving as an orifice 29. The orifice 29 is preferably cone frustum shaped. The cupola of the screw-on cap 28 has coaxial cylindrical walls 30 and 31 obtained in its concave part. The cylindrical part 30 thins in its interior downwards and it is inserted between the conduits 16 and 17 respectively for air and the liquid.

The cylindrical wall 31, externally coaxial to the cylindrical wall 30, has on its inner side an inner counter-thread 37 destined to engage the outer thread 14 of the cylindrical body 4 of the nebuliser.

In this way, when the screw-on cap 28 is screwed on the cylindrical body 4, a passage of the air 32 is narrowed, which is substantially delimited by the conduit of the air 16 and by the cylindrical wall 30. The passage for air 32 is in communication with interior of the bottle 3 through the through hole 18. Downstream, the passage for air 32 ends in a mixing chamber 33, which is delimited by the upper section 20 and by the screw-on cap 28. The mixing chamber 33 substantially has variable geometry. The dimension of minimum amplitude of the mixing chamber 33 is given by the abutment of the inner concave wall of the screw-on cap 28 with the upper end of the body 4 of the nebuliser 1. In this condition, the tip cap 27 is fully inserted in the exhaust orifice 29.

The mixing chamber 33, moreover, borders at one side with the end of the upper section of conduit for the liquid 17 and at the other with the exhaust orifice 29. In the mixing chamber 33 the liquid that flowed out of the related conduit 17 is united with the air coming from the passage 32.

Figure 4:
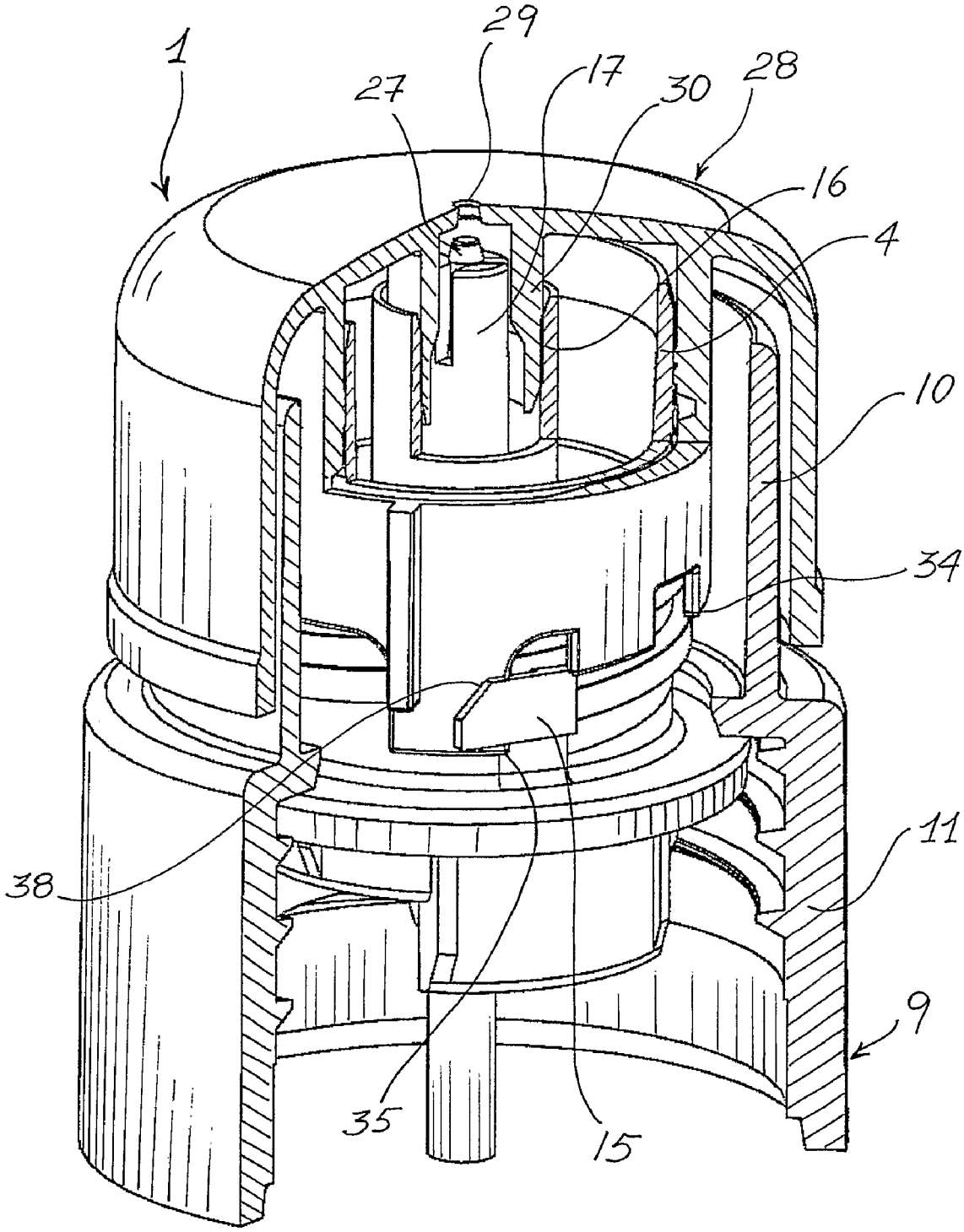
FIG. 4 is a schematic axonometric, partially cut off view of the nebuliser of FIG. 1, in almost completely open position.

The cylindrical wall 31 of the screw-on cap 28 also has, as better shown in FIG. 3 and in FIG. 4, similar to FIG. 3, appropriate slots 34, which interrupt the lower profile 41 of the wall 31 itself, which is inclined according to the same angle as the cylindrical helix of the thread 14. The height of the lower profile 41 is calibrated in such a way that it can slide with interference on the anti-unscrewing tabs 15, contrasting the rotation by the friction thereby generated. Interrupting the lower profile 41 of the cylindrical wall 31, the slots 34 create a discontinuity of contrasting action just described, thereby producing a "stepped" rotation which makes the angular positioning of the screw-on cap more accurate. The slots 34 end with projections 35, two in the illustrated embodiment, each of which engages the corresponding anti-unscrewing tab 15 as shown in FIG. 4. Each projection 35 constitutes a contrasting means operating mutually with the corresponding anti-unscrewing tab 15 of the body 4. This occurs when the screw-on cap 28 is unscrewed to the maximum extent, without being freed from the thread. From this position of maximum opening allowed for the screw-on cap 28, screwing clockwise the cap moves into the intermediate position shown in FIG. 3. In this figure, it can be observed that the tabs 15 are overcome by the lower profile 41 of the cylindrical wall 31 of the screw-on cap 28, the passage being interrupted by the slots 34.

The flows of air and liquid, which take place simultaneously when the bottle is squeezed manually, converge into the mixing chamber 33, and therefrom they are lastly ejected from the exhaust orifice 29 in nebulised form.

The screw-on cap 28 is screwed onto the thread 14 obtained on the outer wall of the body 4, coaxial with the conduits for the air 16 and for the liquid 17 and with the exhaust orifice 29. Once it is screwed onto the body, said device cannot be removed thanks to the anti-unscrewing tabs 15 which lock the opening in the position defined by the projection 35, while still allowing the screwing required for assembling the parts. Said projections thus define the fully open position of the nebulisation system, whilst the fully closed position is identified by the forcing of the screw-on cap 28 on the upper end of the body 4, in such a way as to assure the correct tightening of the coupled parts; in these conditions, the conical coupling between the exhaust orifice 29 of the lid and the tip cap 27 assures the sealing of the nebuliser.

During the unscrewing of the screw-on cap 28, the geometry of the mixing chamber 33 and of the front portion of the air passage 32 changes, so that the closure device itself also acts as a regulator of the characteristics of the nebulised jet, determining a progressive increase both of the flow rate and of the size of the particles.

Figure 5:
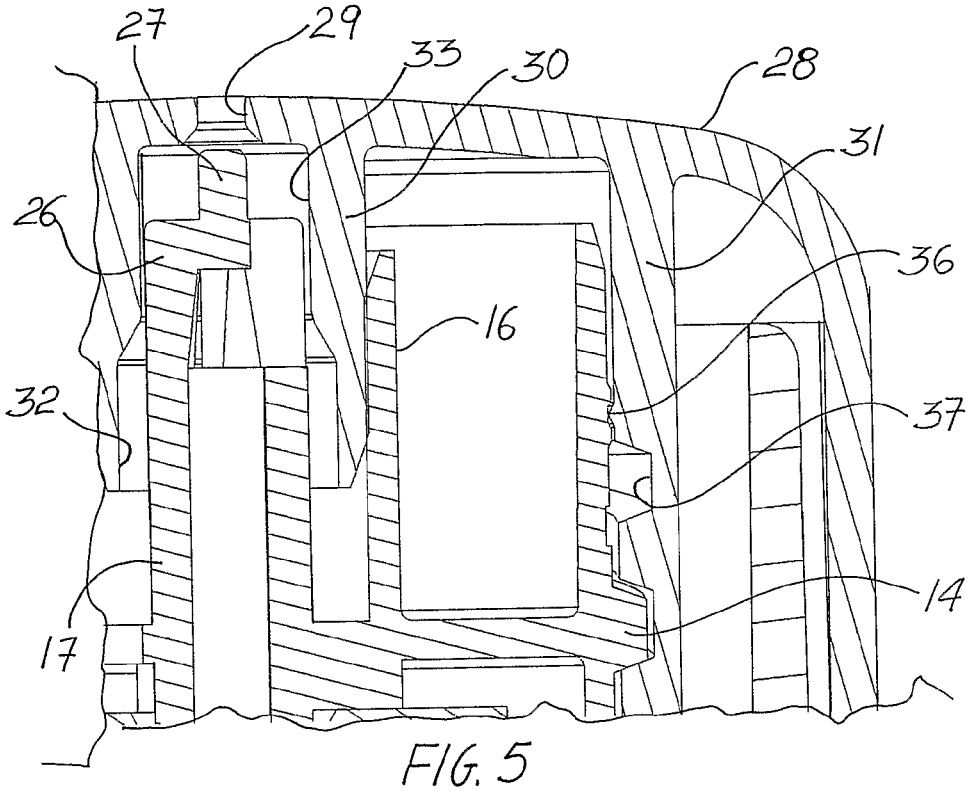
FIG. 5 is a partial enlarged section of the nebuliser of FIG. 3.
Figure 6:
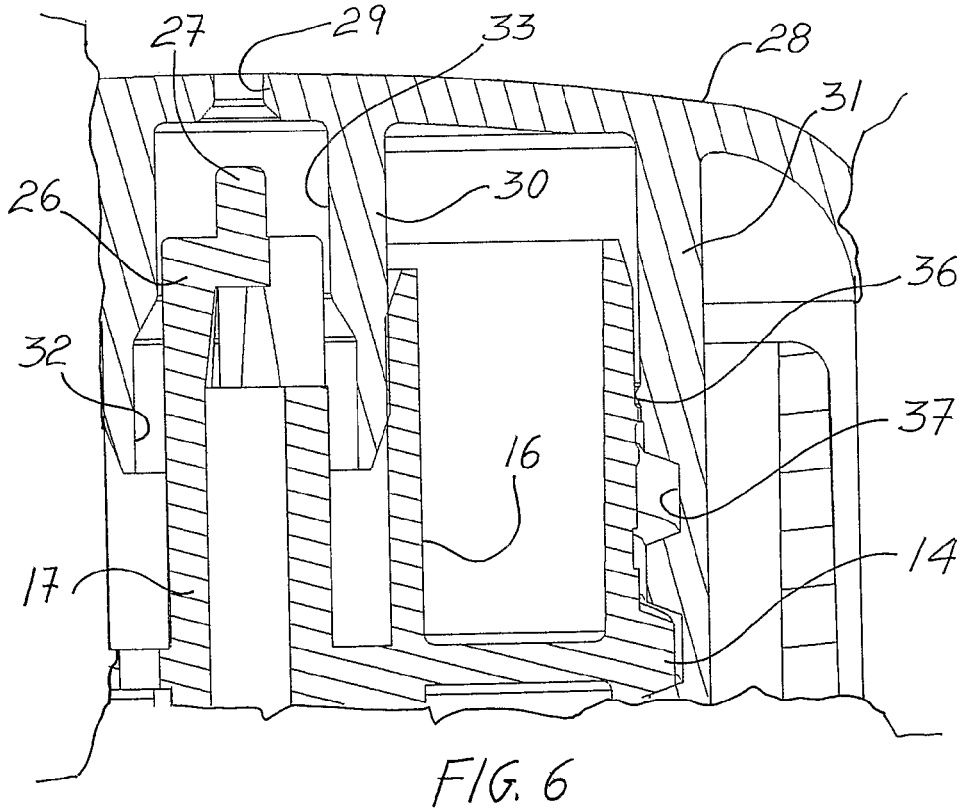
FIG. 6 is a partial enlarged section of the nebuliser of FIG. 4.

In FIGS. 5 and 6, which are enlarged details of FIGS. 3 and 4, are shown two positions of the tip cap 27 with respect to the exhaust orifice 29 which clearly visualise the changing of said geometry.

In FIGS. 5 and 6, the reference number 36 generically designates regions of slight antagonist diametrical projections and recessions, obtained in the inner surface of the cylindrical wall 31 and in the outer surface of the body 4. Said projections and recessions allow to create a resistance to rotation of the screw-on cap 28, which alerts the user that a position that allows to regulate the jet has been reached, identifying at least two positions of the screw-on cap whereto correspond more common operating conditions. The user can thus easily intercept said positions during the opening rotation, whilst retaining the ability adjust with continuity the flow between the extreme open and closed positions. This constructive expedient can be considered alternative or additional to the "stepped" positioning operated by means of the slots 34, described above.

It should be readily apparent that many modifications and variants can be made to the above described embodiment of the invention. As mentioned previously, the threaded ring nut that secures the body of the nebuliser on the neck of the bottle can be replaced by a different retaining member for a different type of mounting, e.g. set-in. The threaded ring nut or other retaining member can be built in a single piece with the body of the nebuliser.

Moreover, although in the embodiment described above the axis according to which the flow occurs and ultimately the jet of the nebulised liquid coincides with the axis of the bottle neck, said axes may also not coincide and be oriented in any direction independently of each other.

The invention claimed is:

1. An adjustable and sealable jet nebuliser for a bottle that is elastically deformable by squeezing, able to be mounted on a mouth of a neck of a bottle and comprising a liquid conduit with first and second ends, the liquid conduit being connected, at the first end by a check valve, to a suction tube which draws a liquid contained within the bottle from under a volume of air; the liquid conduit terminating at the second end in a mixing chamber provided with a central exhaust orifice through which the liquid is discharged outwards from the mixing chamber; an air conduit communicating with said volume of air contained within the bottle, said air conduit surrounding the liquid conduit and merging into said mixing chamber, where the liquid flowing from the liquid conduit mixes with the air flowing from the air conduit, wherein said air conduit and said liquid conduit are obtained coaxially in a cylindrical body, which has a portion projecting from the mouth of the bottle neck; said cylindrical body presenting on its projecting portion an external thread to be engaged with an internal counter-thread obtained on a screw-on cap, provided with the central exhaust orifice, wherein the screw-on cap has a cylindrical wall, to be inserted between the air conduit and the liquid conduit, to create said mixing chamber, with variable geometry, defined by an upper section of the liquid conduit and by the cylindrical wall and the central exhaust orifice of the screw-on cap; and wherein said liquid conduit has on its second end an arm oriented upwards, bearing, at its free end, a tip cap, able to be fully inserted into said central exhaust orifice whilst the screw-on cap is screwed onto the cylindrical body, until sealing the nebuliser.

2. Nebuliser as claimed in claim 1, wherein at the complete sealing of the nebuliser said screw-on cap abuts an upper end of said cylindrical body.

3. Nebuliser as claimed in claim 1, wherein said external thread of the cylindrical body and said internal counter-thread of the screw-on cap have mutual contrast means able to prevent the complete unscrewing of the screw-on cap from the cylindrical body.

4. Nebuliser as claimed in claim 3, wherein said mutual contrast means are constituted by at least one anti-unscrewing tab fastened tangentially to the cylindrical body and by an abutment, obtained inferiorly in the screw-on cap to serve as an abutment for the anti-unscrewing tab.

5. Nebuliser as claimed in claim 4, wherein said screw-on cap has a cylindrical wall in a lower profile whereof, inclined by the same angle as said internal thread, are obtained slots, which interrupt the lower profile to produce a "stepped" rotation for an accurate angular positioning of the screw-on cap.

6. Nebuliser as claimed in claim 1, wherein antagonist diametrical projections and recessions are obtained on the cylindrical body in proximity to and at the same side as the thread and, respectively, in proximity to and at the same side as the counter-thread of the screw-on cap upon reaching the predetermined screwing of the screw-on cap on the cylindrical body to obtain an adequate regulation of the flow rate of nebulised liquid in the mixing chamber with variable geometry and hence in the exhaust orifice.

7. Nebuliser as claimed in claim 1, wherein said tip cap and said central exhaust orifice have cone frustum shape.

8. Nebuliser as claimed in claim 1, wherein said cylindrical wall of the screw-on cap has walls which become thinner downwards.

9. Nebuliser as claimed in claim 1, wherein said cylindrical body is mounted on the mouth of the neck provided with an external thread, with the interposition of a gasket, through a ring nut provided with an internal counter-thread able to engage the external thread.

10. Nebuliser as claimed in claim 9, wherein said ring nut has a cylindrical portion projecting from the mouth, and said screw-on cap is cupola-shaped with peripheral portions able to overhang said cylindrical portion.

11. An adjustable and sealable jet nebuliser for a bottle that is elastically deformable by squeezing, able to be mounted on a mouth of a neck of a bottle and comprising a liquid conduit with first and second ends, the liquid conduit being connected, at the first end by a check valve, to a suction tube which draws a liquid contained within the bottle from under a volume of air; the liquid conduit terminating at the second end in a mixing chamber provided with a central exhaust orifice through which the liquid is discharged outwards form the mixing chamber; an air conduit communicating with said volume of air contained within the bottle, said air conduit surrounding the liquid conduit and merging into said mixing chamber, where the liquid flowing from the liquid conduit mixes with the air flowing from the air conduit, wherein said air conduit and said liquid conduit are obtained coaxially in a cylindrical body, which has a portion projecting from the mouth of the bottle neck; said cylindrical body presenting on its projecting portion an external thread to be engaged with an internal counter-thread obtained on a screw-on cap, provided with the central exhaust orifice, wherein the screw-on cap has a cylindrical wall, to be inserted between the air conduit and the liquid conduit, to create said mixing chamber, with variable geometry, defined by a portion of the liquid conduit, by an inner portion of the screw-on cap and by the cylindrical wall; wherein said liquid conduit has on its second end an arm oriented upwards, bearing, at its free end, a tip cap, able to be fully inserted into said central exhaust orifice whilst the screw-on cap is screwed onto the cylindrical body, until sealing the nebuliser, and wherein said internal counter-thread of the screw-on cap have mutual contrast means able to prevent the complete unscrewing of the screw-on cap from the cylindrical body, said mutual contrast means being constituted by at least one anti-unscrewing tab fastened tangentially to the cylindrical body and by an abutment, obtained inferiorly in the screw-on cap, which mutually engages the anti-unscrewing tab when the screw-on cap is unscrewed to the maximum extent without being freed from the thread.

* * * * *